US005662072A

United States Patent [19]

Suzuki et al.

[11] Patent Number: 5,662,072

[45] Date of Patent: Sep. 2, 1997

[54] ENGINE WARMING-UP APPARATUS FOR A VEHICLE AND HEAT INSULATING DEVICE

[75] Inventors: Kazutaka Suzuki; Yasutoshi Yamanaka, both of Kariya; Yoshimitsu Inoue, Toyoake, all of Japan

[73] Assignee: Nippondenso Co., Ltd., Kariya, Japan

[21] Appl. No.: 652,362

[22] Filed: May 23, 1996

[30] Foreign Application Priority Data

May 26, 1995 [JP] Japan ..... 7-128191
Feb. 6, 1996 [JP] Japan ..... 8-019921

[51] Int. Cl.[6] ..... F01P 11/02

[52] U.S. Cl. ..... 123/41.14; 123/41.27; 123/142.5 R

[58] Field of Search ..... 123/41.14, 41.27, 123/142.5 R

[56] References Cited

U.S. PATENT DOCUMENTS 3,265,048 8/1966 Herbon ..... 123/41.14

FOREIGN PATENT DOCUMENTS 2363686 6/1975 Germany ..... 123/41.14
3922737 1/1991 Germany ..... 123/41.14
A-58-133415 8/1983 Japan .
U-2-92054 7/1990 Japan .
6213116 8/1994 Japan ..... 123/41.14
419913 11/1934 United Kingdom ..... 123/41.14

*Primary Examiner*—Erick R. Solis
*Attorney, Agent, or Firm*—Harness, Dickey & Pierce

[57] ABSTRACT

An engine warming-up apparatus includes a reserve tank integrally provided with a heat insulating device provided in a coolant circuit in which coolant for cooling an internal combustion engine flows. The reserve tank includes a reserve tank body secured to the top of a tank base, a connection pipe for connecting between an outlet pipe of the tank base and the inside of the reserve tank body, and a heat insulating device located-between the tank base and the reserve tank body and covered by the reserve tank body. A degassing pipe is provided at the top of the heat insulating device so as to communicate between the inside of the heat insulating device and the inside of the reserve tank body. A water filling opening of a hot water supply pipe is formed around the top of the inside space of the heat insulating device. In this way, a high temperature coolant is firstly supplied at a cold start, thereby improving warming up performance.

14 Claims, 14 Drawing Sheets

ENGINE WARMING-UP APPARATUS FOR A VEHICLE AND HEAT INSULATING DEVICE

CROSS REFERENCE TO RELATED APPLICATION

This application is based on and claims priority from Japanese application Nos. Hei. 7-128191 filed on May 26, 1995 and Hei. 8-19921 filed on Feb. 6, 1996, the contents of which are incorporated herein by reference.

BACKGROUND OF THE INVENTION

1. Field of the Invention

The present invention relates to an engine warming-up apparatus for a vehicle to warm up an internal combustion engine in utilizing a high temperature coolant heat-accumulated within a heat insulating device disposed in an engine coolant circuit. More particularly, the present invention relates to an engine warming-up apparatus having an improved degassing function performed in the heat insulating device.

2. Description of Related Art

A cooling system used for a water-cooled engine has been mounted on various vehicles to cool the engine at a proper temperature. FIG. 14 shows such a conventional cooling system 100 mounted on a vehicle to cool an internal combustion engine 101. In the vehicle, heat released from the engine 101 is utilized for heating the passenger compartment. The cooling system 100 includes, such as, a radiator 103, a thermostatic control valve 104, and a heater core 105, which are connected between the engine 101 and a water pump 102 in forming respective closed loops. A completely closed reserve tank, or degassing tank, 107 is coupled to an upper tank 106 of the radiator 103, whose lower tank 108 is connected to a thermostat 109. The internal pressure in the engine cooling system 100 is set at a predetermined value by a pressure cap 110 attached to the reserve tank 107.

A pressure circuit 111 connects the reserve tank 107 to the inlet of the water pump 102 to apply a uniform pressure onto respective pertinent portions of the engine 101. A degassing circuit 112 communicates the upper tank 106 of the radiator 103 with the reserve tank 107 to degas the coolant. The thermostat 109 communicates with the inlet of the water pump 102 through a suction pipe 113. The coolant of engine 101 bypasses the radiator 103 through a bypass pipe 114 at low temperature. In the cooling system for the engine 101 equipped with the completely closed reserve tank 107, rubber hoses 121 are used as shown in FIG. 15 to communicate the coolant between the radiator 103 and the reserve tank 107, between the engine 101 and the reserve tank 107, and between the reserve tank 107 and the inlet of the water pump 102. The hoses 121 are secured using binding members 122 and 123, such as hose bands or the like, to the respective above portions.

With the cooling system 100 as described above, when the water-cooled engine 101 is restarted after made inoperative for a long time, and particularly during winter time when the outside temperature is low, the engine 101 needs a warming up operation for a certain period. As a result, there raise problems that such a warming up operation grossly increases the fuel consumption, brings economic disadvantages, and impairs the drive performance of the vehicles until the engine reaches a suitable temperature.

To solve such problems, some prior arts have been proposed as disclosed in JP-A-58-133415 and JP-U-2-92054. In an engine warming-up apparatus for a vehicle disclosed in JP-A-58-133415, a heat insulating tank storable of the almost whole volume of the coolant in the cooling circulation is provided to supply to the engine a high temperature coolant within the heat insulating tank at a time of the engine start to warm up the engine. In an engine warming-up apparatus for a vehicle JP-U-2-92054, an accumulator for warming up the engine, which is connected to the engine and the radiator through pipes, is arranged to exchange the coolant in the accumulator with the coolant on the engine side according to the temperature difference given from temperature sensors attached to the accumulator and the engine (or radiator), respectively.

The prior art disclosed in JP-A-58-133415, however, needs to open an electromagnetic valve placed in a coolant passage when a high temperature coolant in the heat insulating device is to be supplied to the engine. Such construction makes the cost extremely higher since a controller for opening and closing the electromagnetic valve is required. Moreover, the temperature of the coolant within the heat insulating device tends to be lowered more or less, so that a portion of the coolant, having a low temperature, may fall downward and gather together at a bottom of the heat insulating device. The above prior art has an insulator outlet opened around the lower portion of the insulator. As a result, when the coolant within the reserve tank is supplied to the engine, the coolant at a relatively low temperature is first supplied, thereby deteriorating the warming-up function of the system. Furthermore, the reserve tank has a large volume which can accumulates almost the whole amount of the coolant in the cooling circuit, and such a reserve tank requiring a large content becomes more difficult to be mounted in the engine compartment of vehicles such as automobiles, because the engine compartment tends to be denser these days.

The prior art disclosed in JP-U-2-92054, as well as the prior art in JP-A-58-133415, needs to open the valve when the high temperature coolant stored in the accumulator is supplied to the engine, so that the system requires a controller to open and shut the valve, which leads to extremely high costs. The accumulator is not provided with a degassing passage in the accumulator. Therefore, air is unavoidably trapped at the top of the accumulator when the coolant is poured in the accumulator, so that there raises a problem that the coolant cannot be filled in the whole volume of the heat insulating device.

SUMMARY OF THE INVENTION

It is an object of the invention to provide an engine warming-up apparatus capable of improving water filling performance in a heat insulating device (or more specifically, an insulator body), a degassing function in the heat insulating device, and a warming-up operation for an engine.

It is another object of the invention to provide an engine warming-up apparatus capable of installing a heat insulating device in a limited installation space with relatively low cost by commonly using the coolant in the heat insulating device and the reserve tank.

According to the present invention, at least an upper side of a heat insulating device is covered by a reserve tank, and a degassing passage is formed around the top portion of the heat insulating device so as to communicate with the inside of the reserve tank. An outlet pipe is so formed in the heat insulating device as to open around the top portion of the heat insulating device to flow the coolant out of the heat insulating device.

When the coolant is poured in the heat insulating device, the coolant or water is filled through the water filling opening of the reserve tank. The coolant filled in the reserve tank through the water filling opening is further supplied into the heat insulating device by way of the cooling circulation of the engine. Air in the heat insulating device, according to supply of the coolant, is discharged to the reserve tank through the degassing passage formed around the top portion of the heat insulating device. The engine warming-up apparatus thus can improve the warming-up operation of the engine, because the apparatus can supply a relatively high temperature coolant to the engine from the heat insulating device. The heat insulating device is covered at least at the upper side thereof by the reserve tank, thereby making it possible] to install the heat insulating device in a limited installation space. The coolant constantly circulates through the heat insulating device, and therefore, it will be unnecessary to close the communication between the heat insulating device and the coolant circulation for the engine. As a result, since no mechanical or electrical valve is required, and further since no controller for controlling such a valve is required, the production costs for the engine warming-up apparatus can be reduced.

In a preferred embodiment, a pressing member, specifically, a resilient body, such as a leaf spring, is placed between the top of the heat insulating device and the reserve tank to push the heat insulating device on an inner wall face of a tank base or a supporting member, thereby surely securing the heat insulating device to the reserve tank body even if the clearance between the heat insulating device and the reserve tank body is fluctuated. The pressing member can support the heat insulating device at an upper portion of the heat insulating device with respect to the center of gravity, thereby reducing mechanical binding members, and further reducing the number of parts and assembly processes as well as the production costs.

BRIEF DESCRIPTION OF THE DRAWINGS

The above and other objects and features of the invention are apparent to those skilled in the art from the following preferred embodiments thereof when considered in conjunction with the accompanied drawings, in which:

FIG. 10A shows the reserve tank for 2.5 liters, and FIG. 10B shows the reserve tank for 3.0 liters;

DETAILED DESCRIPTION OF THE PREFERRED EMBODIMENTS

Figure 1:
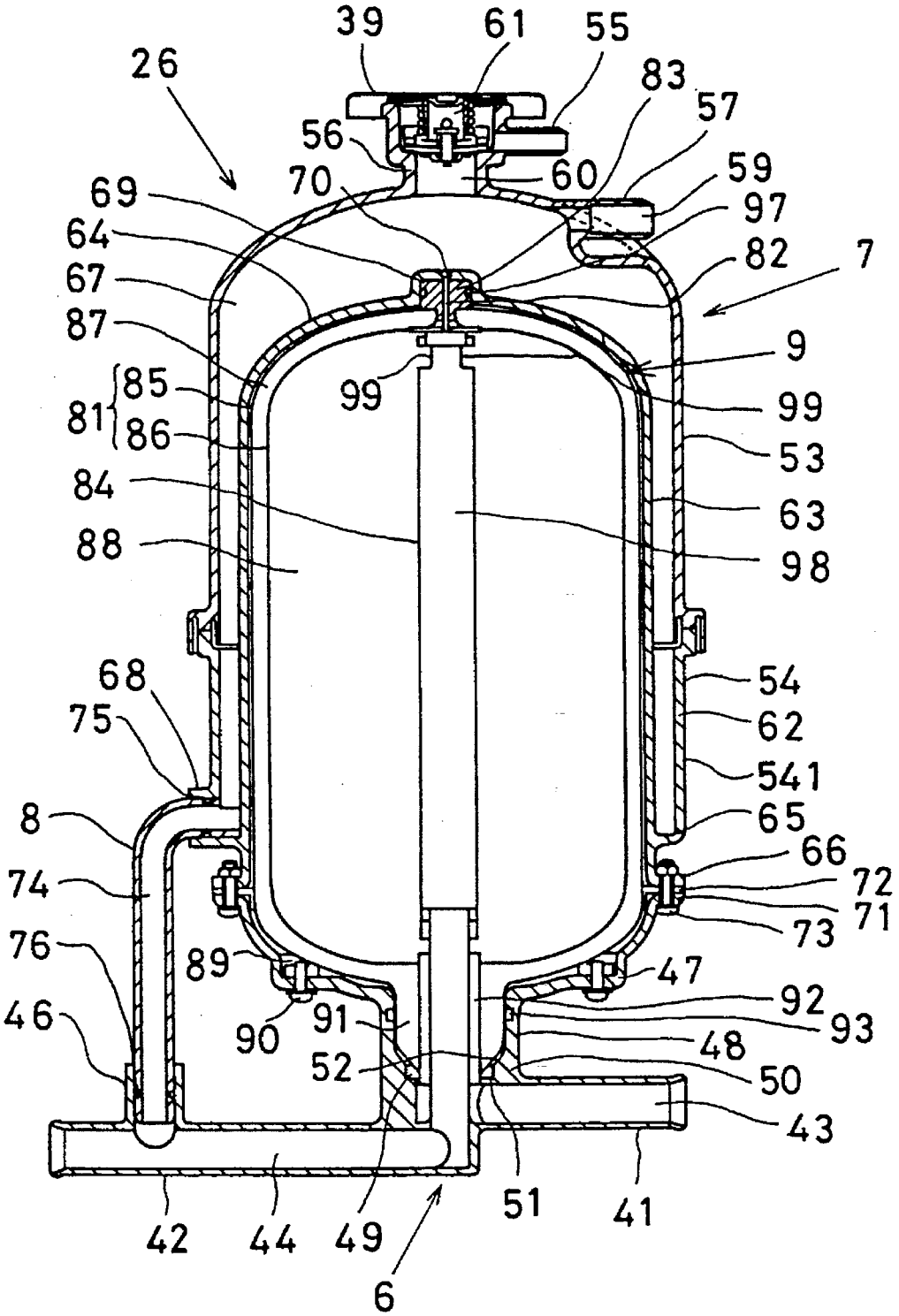
FIG. 1 is a cross-sectional view showing the whole structure of a reserve tank integrally provided with a heat insulating device according to a first embodiment of the present invention.
Figure 2:
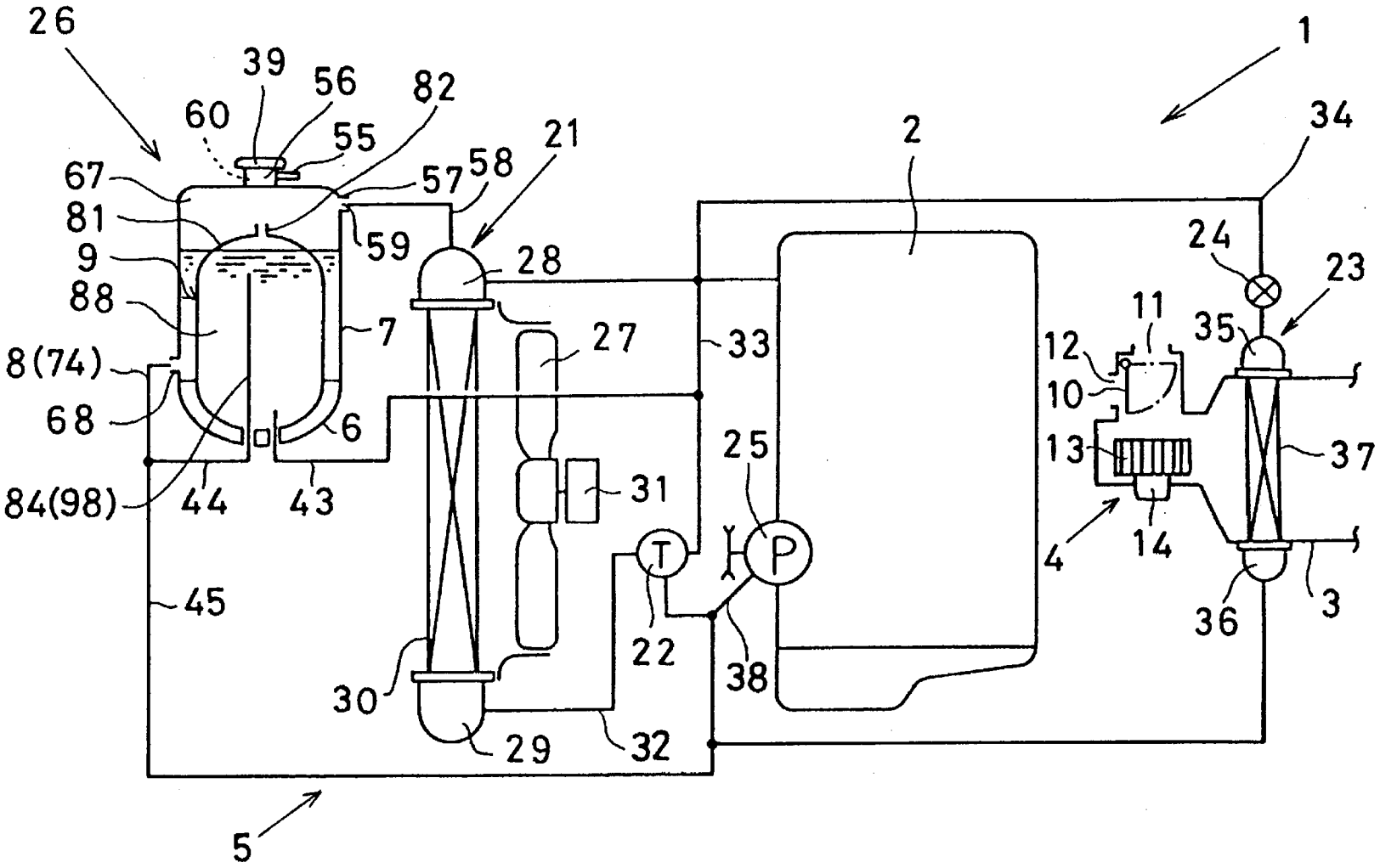
FIG. 2 is a coolant system diagram showing the whole configuration of a warming-up apparatus for an automobile according to the first embodiment.
Figure 3:
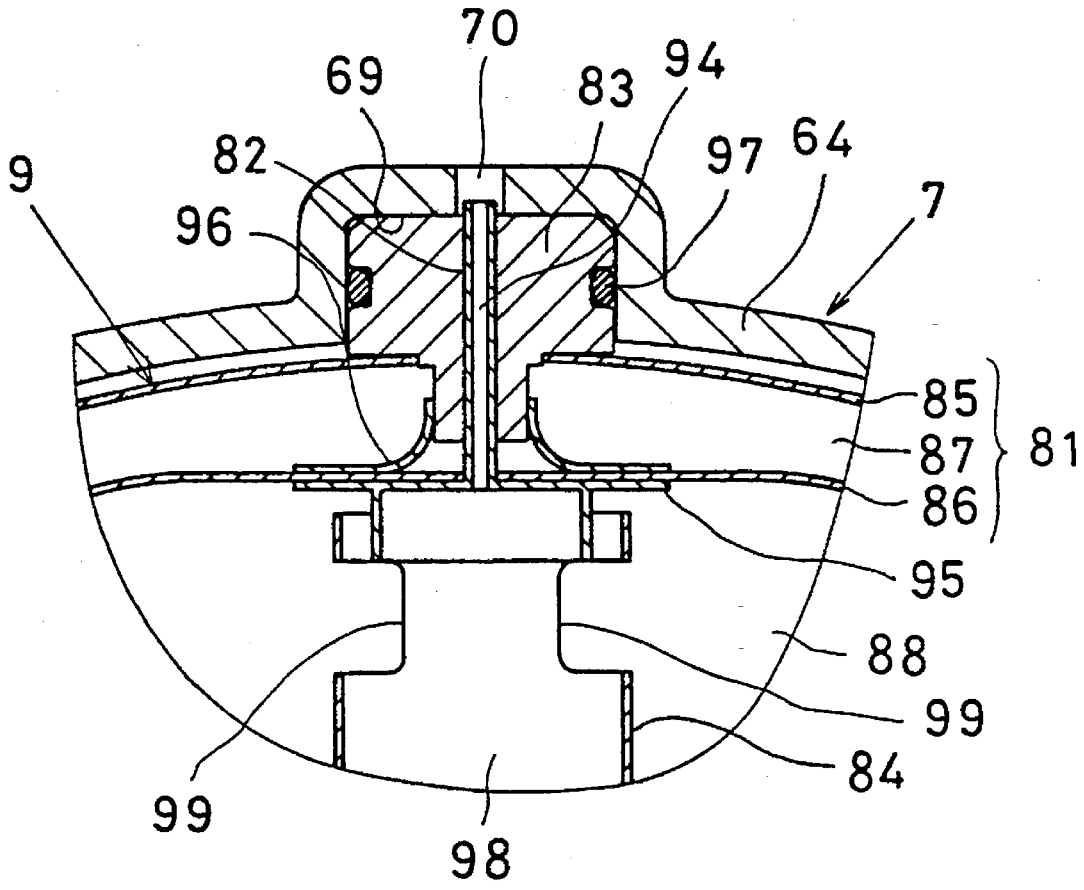
FIG. 3 is a cross-sectional view showing an essential structure of the reserve tank integrally provided with the heat insulating device shown in FIG. 1.

A first embodiment is described with reference to FIGS. 1 to 3. In FIGS. 1 to 3, an engine warming-up apparatus for a vehicle according to the invention is specially applied to a system for heating an engine and performing engine warming-up for an automobile.

The system 1 for heating and warming up the engine for the automobile serves as a heat accumulation type heating apparatus for the automobile to heat the passenger compartment of the automobile, serves as an engine warming-up apparatus for the automobile to promptly warm up a water-cooled internal combustion engine 2, and serves as an engine cooling apparatus for the automobile to cool the engine 2. The system 1 for heating and warming-up the engine includes a duct 3 for an air conditioning apparatus mounted on the automobile, a centrifugal fan 4 arranged on a more upstream side of the duct 3, a coolant circuit 5 for circulating the coolant (or hot water) for the engine 2, and the like. The coolant can be selected from an antifreeze mainly made of ethylene glycol or a long life coolant made of a mixture of an antifreeze and a rust preventive agent.

An inside/outside air switching door 10 for selecting inside and outside air is pivotably provided on the upstream side of the duct 3. The inside/outside air switching door 10 switches an outside air introduction mode for introducing outside air (air outside of the automobile) from an outside air inlet 11 and an inside air circulation mode for introducing inside air (air in the passenger compartment) from an inside air outlet 12. The centrifugal fan 4 includes a blower 13 for blowing air flow directing the passenger compartment, a blower motor 14 as an electromagnetic motor for rotating the blower 13, a scroll casing forming an upstream portion of the duct 3, and the like. Driving means such as a hydraulic motor can be used instead of the blower motor.

The coolant circuit 5 is shown in detail with reference to FIGS. 1 to 3. The coolant circuit 5 forms a coolant system for the internal combustion engine 2. The coolant circuit 5 includes a radiator 21, a thermostat 22, a heater core 23, a heater valve 24, a water pump 25, and a reserve tank 26 integrally provided with a heat insulating device.

The engine 2 is a water-cooled gasoline engine or a water-cooled diesel engine as a targeted object to which a high temperature coolant is supplied. The engine 2 is installed within the engine compartment of the automobile. In the engine 2, the coolant is compulsively circulated through the water jacket formed at a cylinder block and a cylinder head, thereby cooling so the respective parts of the engine 2 at a proper temperature as to operate effectively.

The radiator 21, as a heat exchanger, radiates the heat from the coolant to the air and is disposed in the engine compartment of the automobile at a position readily receiving winds while the automobile is running. The radiator 21 cools the coolant by heat-exchange between the air passing by the outside of tubes and the coolant flowing through the tubes, using winds while the automobile is running and using the cool air by a cooling fan 27. The radiator 21 includes a core portion 30 in which a plurality of tubes is arranged between an upper tank 28 and a lower tank 29. The cooling fan 27 is an electric fan rotatably driven by a fan motor 31. Drive means such as a hydraulic motor may be used instead of the fan motor 31.

The thermostat 22 includes a valve for automatically regulating the temperature of the coolant and is installed to a heat radiating passage 32 through which the coolant passes in the radiator 21. The thermostat 22 operates, while the coolant temperature is lower than a predetermined temperature (for example, 85° C.), to quickly warm up the engine 2 so as to be closer to the proper temperature by fully closing the valve, thereby the coolant flows through a bypass passage 33 for bypassing the radiator 21. The heater core 23 is a hot water type heater and also a heat exchanger to radiate the heat to the air flowing through the duct 3. The heater core 23, as air heating means, is installed to a heater passage 34 and performs heat-exchange between the air directing the passenger compartment and the coolant holding the exhaust heat of the engine 2, thereby heating the air to warm up the passenger compartment. The heater core 23 includes a core portion 37 in which a plurality of tubes is arranged between an inlet tank 35 and an outlet tank 36.

The heater valve 24 is provided in the heater passage 34 and serves as a hot water valve for controlling the supply and stop of supply of the coolant absorbing the exhaust heat of the engine 2 to the heater core 23 by opening and closing the heater passage 34. A flow control valve interlocked with a temperature control lever provided at a control panel in the passenger compartment, may be used as the heater valve 24 to control the opening degree of the heater passage 34.

The water pump 25 is mounted on the engine 2 and provided at the coolant inlet of the engine 2. The water pump 25 produces water circulations such that the coolant flowing out of the radiator 21 and the heater core 23 compulsively circulate into the water jacket of the engine 2, rotated by the engine as drive means via a transmission member such as a belt.

next, referring now to FIGS. 1 to 3, the reserve tank 26 integrally provided with the heat insulating device is described in detail. The reserve tank 26 integrally provided with the heat insulating device includes a tank base 6, a reserve tank body 7 secured on the top of the tank base 6, a connection pipe 8 for connecting between the inside of the tank base 6 and the inside of the reserve tank body 7, and the heat insulating device 9 sandwiched between the tank base 6 and the reserve tank body 7, and the like.

The tank base 6 is a support member and is integrally molded with a resin materials such as nylon or polypropylene in a predetermined shape. The tank base 6 is integrally molded with an inlet pipe 41 for introducing the coolant into the heat insulating device 9 and an outlet pipe 42 for delivering the coolant out of the heat insulating device 9. The inlet pipe 41 is a round tube extending horizontally and has a coolant passage 43 therein. The coolant passage 43 is bifurcated from a midway of the bypass passage 33. The outlet pipe 42 is a round tube extending in a reversed-L shape having horizontal and vertical portions and has a coolant passage 44 therein. The coolant passage 44 joins a pressure circuit (coolant passage) 45. A connection port 46 is formed at a midway of the outlet pipe 42 to which the lower portion of the connection pipe 8 is inserted. The connection port 46 extends vertically upward from an outer wall of the outlet pipe 42.

The tank base 6 is integrally molded, on the upper side of the inlet pipe 41, with a cup-shaped supporting member 47 on which the heat insulating device 9 is mounted, and a cylindrical supporting member 48 extending downward from a portion around the center of the supporting member 47. In the supporting member 48, a connection chamber 49 is formed to communicate with the coolant passage 43. A partition portion 50 is formed at the border between the supporting member 48 and the inlet pipe 41 to separate the connection chamber 49 from the coolant passage 43. The partition portion 50 includes a protrusion portion 51 protruded partly inward from the periphery, a taper portion (inclined portion) 52 formed on the top side of the protrusion portion 51.

Next, the reserve tank body 7 as a completely closed reserve tank is described with reference to FIGS. 1 and 3. The reserve tank body 7 separates entrained air from the coolant in the cooling circuit 5 (cooling system) while the coolant is normally circulated therethrough. Only the coolant is thus returned to the engine 2 through the connection pipe 8 and the outlet pipe 42 of the tank base 6. The reserve tank body 7 includes an upper tank 53 and a lower tank 54, which are integrally molded with resin materials such as a nylon or polypropylene having a low water absorption rate as well as hardly dyeing the coolant.

The upper tank 53 has a reverse U-shaped cross-section and is integrally molded with a neck filler 56 having an overflow pipe formed in a round tube shape at the uppermost portion. An inlet pipe 57 having a round tube shape is integrally formed near the neck filler 56 of the upper tank 56. The inlet pipe 57 is formed so as to protrude horizontally from the outer wall of the upper tank 53 and has an inlet passage 59 therein, which communicates with the upper tank 28 of the radiator 21 through a degassing passage (coolant passage) 58. A metal pressure cap 39 is threaded on a filler opening 60 for coolant formed by the neck filler 56. The pressure cap 39 is tightly threaded on the neck filler 56. A vacuum relief valve 61 is installed to the pressure cap 39 for serving as both of a relief valve (positive pressure valve) and a vacuum valve (negative pressure valve). The vacuum relief valve 61 seals the opening of the overflow pipe 55 until the internal pressure reaches a predetermined pressure (for example, 0.9 kg/cm2) in the reserve tank body 7. The vacuum relief valve 61 is opened so that outside air is intaked so as to compensate the negative pressure state, when the temperature in the coolant circuit 5 is lowered while the engine 2 is stopped and when the internal pressure of the reserve tank body 7 becomes lower than the atmospheric pressure.

The lower tank 54 includes an outer cylindrical wall 62 welded t9 the bottom of the upper tank 53, an inner cylindrical wall 63 formed inside the outer cylindrical wall 62, a ceiling portion 64 covering the top end portion of the inner cylindrical wall 63, an installation flange 66 extending below a connection portion 65 at which the outer cylindrical wall 62 and the inner cylindrical wall 63 are connected with each other. The coolant is stored in an inside space 67 in a reversed cup shape surrounded by the outer cylindrical wall 62, the inner cylindrical wall 63, the ceiling portion 64, and the Upper tank 53. A cylindrical skirt 541 is formed by the lower portion of the outer cylindrical wall 62 and by the inner cylindrical wall 63. A connection port 68 having a tube shape into which the an upstream side end of the connection pipe 8 is inserted is integrally molded at the lower portion of the outer cylindrical wall 62. The connection port 68 is formed so as to protrude horizontally from the outer cylindrical wall 62. A round recess 69 having a round hole shape and indented upward is formed around the center of the ceiling portion 64. The recess 69 is formed with an annular hole 70 for communicating between the inside of the heat insulating device 9 and the inside space 67. The installation flange 66 is secured by screwing plural sets of screwing members 73 such as bolts and nuts with angles 72, to the top face of a flange 71 formed at the supporting member 47 of the tank base 6.

Next, the connection pipe 8 is described with reference to FIGS. 1 and 3. The connection pipe 8 is made of a resin materials such as nylon or polypropylene and integrally molded in a round tube shape. The upper end of the connection pipe 8 is folded against the lower end. In the connection pipe 8, the upstream end (upper end) is inserted into the connection port 68 of the reserve tank body 7 whereas the downstream end (lower end) is inserted into the connection port 46 united molded with the outlet pipe 42 of the tank base 6. In the inside of the connection pipe 8, a communication passage 74 for communicating between the inside space 67 of the reserve tank body 7 and the coolant passage 44 of the outlet pipe 42 is formed.

A sealing member 75 such as an O-ring is provided between the outer periphery of the connection pipe 8 at the upstream end and the inner periphery of the connection port 68 to prevent the coolant from leaking from the connection pipe 8. Another sealing member 76 such as an O-ring is provided between the outer periphery of the connection pipe 8 at the downstream end and the inner periphery of the connection port 46 to prevent the coolant from leaking from the connection pipe 8. The connection pipe 8 may be integrally formed with either the tank base 6 or the reserve tank body 7. The connection pipe 8 may be made of a metal and provided in the tank base 6 or the reserve tank body 7 by an insertion molding.

Next, the heat insulating device 9 is described with reference to FIGS. 1 to 3 in detail. The heat insulating device 9 includes an heat insulating body 81 surrounded by the tank base 6 and the reserve tank body 7, a degassing connection pipe 82 arranged at the upper-most end of the heat insulating body 81, an insertion holder 83 for holding the degassing connection pipe 82, and a hot water supply connection pipe 84 for supplying the coolant (hot water) to the engine 2 from the heat insulating body 81.

The heat insulating body 81 includes an outer member 85 and an inner member 86 which are made of stainless steel material, so as to form a vacuum layer 87 therebetween. The heat insulating body 81 accumulates heat and maintains the temperature of the coolant having flowed into an inside space 88 of the body. Alternatively, an insulating layer may be provided for insulating the heat transfer between the inside and the outside instead of the vacuum layer 87. The bottom of the heat insulating body 81 is secured by screwing plural sets of screwing members 90 such as bolts and nuts with angles 89, to the top surface of the supporting member 47 of the tank base 6.

The hot water supply connection pipe 84 passes through a protrusion portion 91 in a cylindrical shape formed at the bottom of the heat insulating body 81. An inlet passage 92 is formed within the protrusion portion 91 to communicate between the coolant passage 43 of the tank base 6 and the inside space 88. The protrusion portion 91 has a tapered outer periphery of the top thereof. The protrusion portion 91 is fitted into the connection chamber 49 of the tank base 6 so that the tip of the protrusion portion 91 is located at substantially the same level of the protrusion 51 of the partition portion 50. A sealing member 93 such as an O-ring is provided between the outer periphery of the protrusion portion 91 and the inner periphery of the supporting member 48 of the tank base 6 to prevent the coolant from leaking therefrom. A heat accumulating agent such as a latent heat type paraffinic wax may be inserted in the heat insulating body 81.

The degassing connection pipe 82 is, as shown in FIG. 2, a pipe integrally formed of one or more resin materials such as nylon or polypropylene, or one or more metal materials such as stainless steel. The degassing connection pipe 82 is arranged to penetrate the top of the heat insulating body 81. A degassing passage 94 is formed inside the degassing connection pipe 82 to communicate between the interior space 88 of the heat insulating body 81 and the interior space 67 of the reserve tank body 7. The top end of the degassing connection pipe 82 is inserted into the hole 70 of the reserve tank body 7. A flange 95 is integrally formed at the bottom of the degassing connection pipe 82 to be in contact with the inner round surface of the inner member 86.

The insertion holder 83 is integrally formed of a resin materials such as nylon or polypropylene, or a metal material such as stainless steel. The insertion holder 83 is contained in the recess 69 of the reserve tank body 7 and is held on the outer member 85 of the heat insulating body 81 through a plate 96. The insertion holder 83 fixedly holds the degassing connection pipe 82 by the inner periphery of the holder 83. A sealing member 97 such as an O-ring is provided between the outer periphery of the inserted holder 83 and the inner wall of the recess 69 to prevent the coolant from leaking therefrom.

The hot water supply pipe 84 is an outlet pipe and is integrally formed of a resin material such as nylon or polypropylene in a round tube shape and arranged as to extend vertically around the center of the heat insulating body 81. An outlet passage 98 is formed within the hot water supply connection pipe 84 for communicating between the interior space 88 of the heat insulating body 81 and the coolant passage 44 within the outlet pipe 42 of the tank base 6. A water supply opening 99 is formed to open the top end portion of the hot water supply connection pipe 84 around the upper-most portion of the heat insulating body 81. The lower end of the hot water supply connection pipe 84 is watertightly connected to the top portion of the outlet pipe 42 of the tank base 6.

An operation of the system 1 for heating and warming up the engine for the automobile is this embodiment is briefly described.

When the coolant is to be poured in the heat insulating body 81, the poured coolant in the inside space 67 of the reserve tank body 7 through the filler opening 60 formed at the neck filler 56, is supplied to the coolant circuit 5 through the connection port 68, the communication passage 74 in the connection pipe 8, the coolant passage 44 in the outlet pipe 42 of the tank base 6, and the like, thereby being further supplied to the water jacket of the engine 2, the radiator 21, and the like. The coolant is also supplied to the inside space 88 of the heat insulating body 81 through the bypass passage 33 of the coolant circuit 5, the coolant passage 43 in the inlet pipe 41 of the tank base 6, the inlet passage 92, and the like.

When the coolant is supplied into the inside space 88 of the heat insulating body 81, the air in the inside space 88 of the heat insulating body 81 is pushed upward in the heat insulating body 81 as the coolant is supplied and is finally discharged into the inside space 67 of the reserve tank body 7 through the degassing passage 94 in the degassing passage 82 installed around the upper-most portion of the heat insulating body 81 and through the hole 70 of the ceiling portion 64. The whole Volume of the interior space 88 of the heat insulating body 81 can therefore be filled with the coolant.

Under such a condition, when the coolant temperature is increased at the predetermined temperature (for example 85° C.) or more, upon the operation of the engine 2, the thermostat 22 is opened, thereby forming a first circulation route (heat radiating route) in which the high temperature coolant absorbing the exhaust heat of the engine 2 in the water jacket of the engine 2 circulates through the upper tank 28 of the radiator 21, the core portion 30, the lower tank 29, the thermostat 22, and the water pump 25 and returns to the engine 2. A second circulation route is also formed in which the coolant circulates from the water jacket of the engine 2 through the upper tank 2 of the radiator 28, the inside space 67 of the reserve tank body 7, the communication passage 74 in the connection pipe 8, the coolant passage 44 in the outlet pipe 42 of the tank base 6, the pressure circuit 45, and the water pump 25 and returns to the engine 2. Similarly, a third circulation route is formed in which the coolant circulates from the water jacket of the engine 2 through the bypass passage 33, the coolant passage 43 in the inlet pipe 41 of the tank base 6, the inside space 88 of the heat insulating body 81, the outlet passage 98 in the hot water supply connection pipe 84, the coolant passage 44 in the outlet pipe 42 of the tank base 6, the pressure circuit 45, and the water pump 25 and returns to the engine 2. While the heater valve 24 is opened, a fourth circulation route (heating route) is formed in which the coolant circulates from the water jacket of the engine 2 through the heater valve 24, the heater core 23, and the water pump 25 and returns to the engine 2.

As shown in FIG. 1, even though the coolant in the inside space 88 of the heat insulating body 81 is not fully filled, the inside space 88 of the heat insulating body 81 is fully filled with the coolant during the operation of the engine 2, or while the automobile is running, because the coolant expands as the coolant temperature in the coolant circuit 5 increases. When the coolant temperature is increased, the coolant may be overflowed into the inside space 67 of the reserve tank body 7 from the top of the inside space 88 of the heat insulating body 81 through the degassing passage 94 in the degassing connection pipe 82 and the hole 70 of the ceiling portion 64. Accordingly, the inside spaces 67 and 88 of the reserve tank body 7 and the heat insulating body 81 are maintained at the same water level at any time.

When the drive of the engine 2 is stopped, the coolant in the inside space 88 of the heat insulating body 81 is maintained at a high temperature. When the engine 2 is quickly warmed-up, the cold coolant flows into the inside space 88 of the heat insulating body 81 through the coolant passage 43 in the inlet pipe 41 of the tank base 6 during a start stage of the engine. At this time, the warm coolant gathers in the top portion of the inside space 88 of the heat insulating body 81. Therefore, the high temperature coolant, which is pushed out by the cold coolant, flows into the outlet passage 98 in the hot water supply connection pipe 84 from the water supply opening 99, circulates through the coolant passage 44 in the outlet pipe 42 of the tank base 6, the pressure circuit 45, and the water pump 25, and returns to the engine 2. in this way, it is possible to improve the warming-up effects by supplying the relatively high temperature coolant to the engine 2.

As described above, in the system 1 for heating and warming-up the engine for the automobile, the reserve tank 26 with the integrated heat insulating device is connected in the coolant circuit 5. That is, by sandwiching the heat insulating device 9 between the reserve tank body 7 and the tank base 6, the heat insulating device 9 is covered by the reserve tank body 7, so that the heat insulating device 9 can be easily installed even in an engine compartment having a comparatively limited installation space.

During the operation of the engine 2, the coolant always circulates in the heat insulating body 81, or the heat insulating device 9, it is not necessary to close the connection between the heat insulating body 81 and the coolant circuit 5 by using mechanical or electromagnetic valves. As a result, the system 1 does not require any mechanical or electromagnetic valve as well as any controller for such a valve, thereby being capable of reducing the production costs of the coolant circuit 5 and the whole cost of the automobiles having such an inexpensive coolant circuit 5.

Since the degassing performance of the heat insulating body 81 can be improved by providing at the upper-most portion of the heat insulating device 9 the degassing connection pipe 82 for removing air from the inside of the heat insulating body 81 to the reserve tank body 7, or heat insulating body 81, the coolant pouring process to the heat insulating body 81 can be easily performed. Moreover, since a relatively high temperature coolant can be supplied to the engine, the quickly warming-up performance for the engine 2 can be improved. Though not shown, the coolant can contribute to warm up a hydraulic temperature controlled by the coolant, thereby improving the heating ability.

Figure 4:
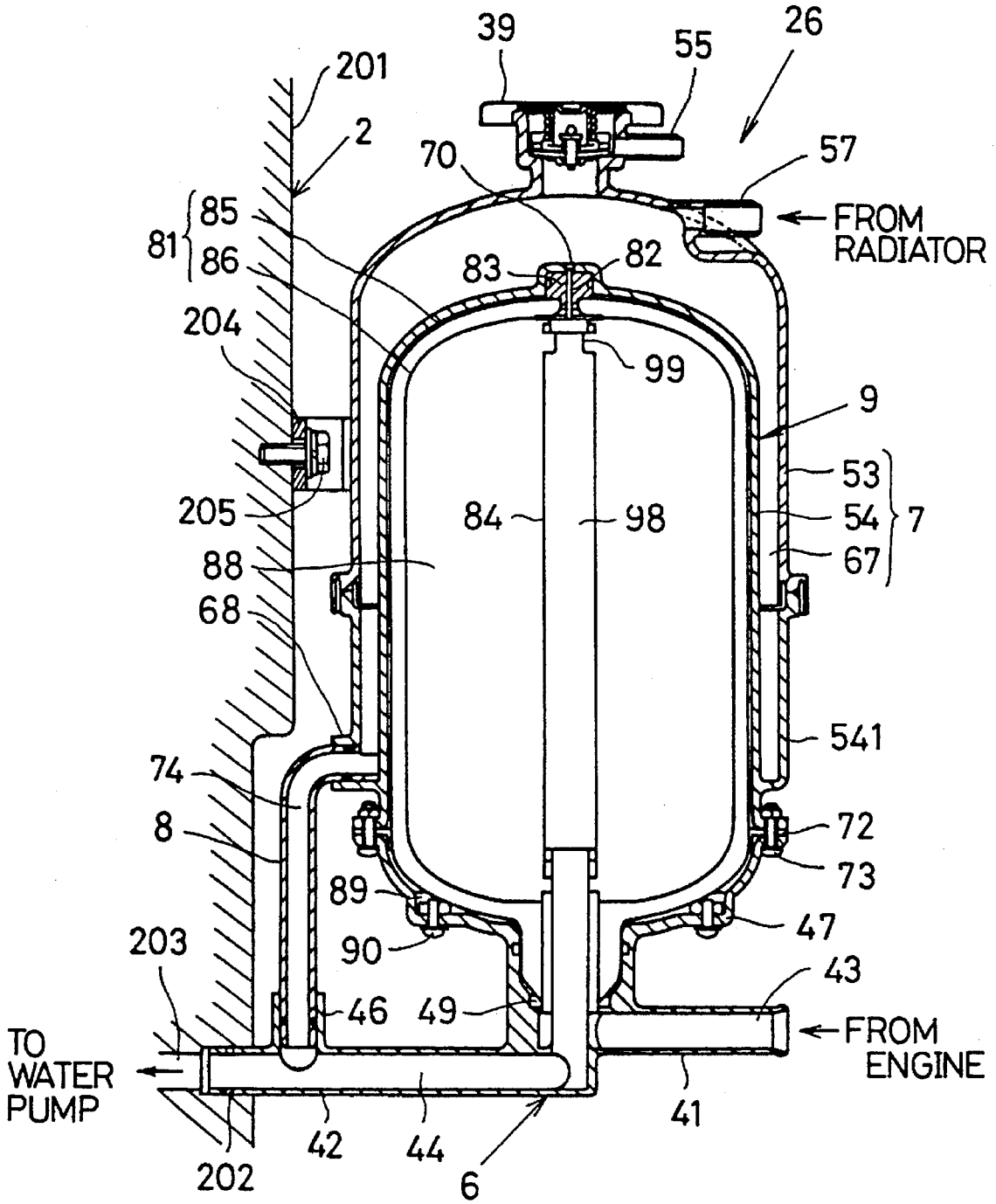
FIG. 4 is a cross-sectional view showing the whole structure of a reserve tank integrally provided with a heat insulating device according to a second embodiment of the present invention.

A reserve tank integrally provided with a heat insulating device of the second embodiment according to the invention is described with reference to FIGS. 4 and 5.

The reserve tank 26, as well as in the first embodiment, includes a tank base 6, a reserve tank body 7, a connection pipe 8, and a heat insulating device 9.

The reserve tank body 7 includes a pressure cap 39, an upper tank 53, a lower tank 54, a connection port (connection hole) 68 integrally molded with the lower tank 54, and the like. The reserve tank body 7 has an inlet pipe 41 for the coolant introducing to the heat insulating device 9, an outlet pipe 42, and a connection port (connection hole) 48 integrally molded with the outlet pipe 42. The heat insulating device 9 is so assembled as to be sandwiched between the cup like shaped tank base 6 and the reserve tank body 7 having an inside space in a reversed cup shape and to be covered by the tank base 6 and the reserve tank body 7. The reserve tank 26 integrally provided with a heat insulating device 9 is mounted onto an engine block 201 of the engine 2 by firmly securing a stay 204 for reserve tank with a binding member 205 such as a bolt after the tip end portion of the outlet pipe 42, to the outer periphery of which a sealing member 202 such as an O-ring is provided, is inserted into an inlet 203 of the engine block 201.

Figure 5:
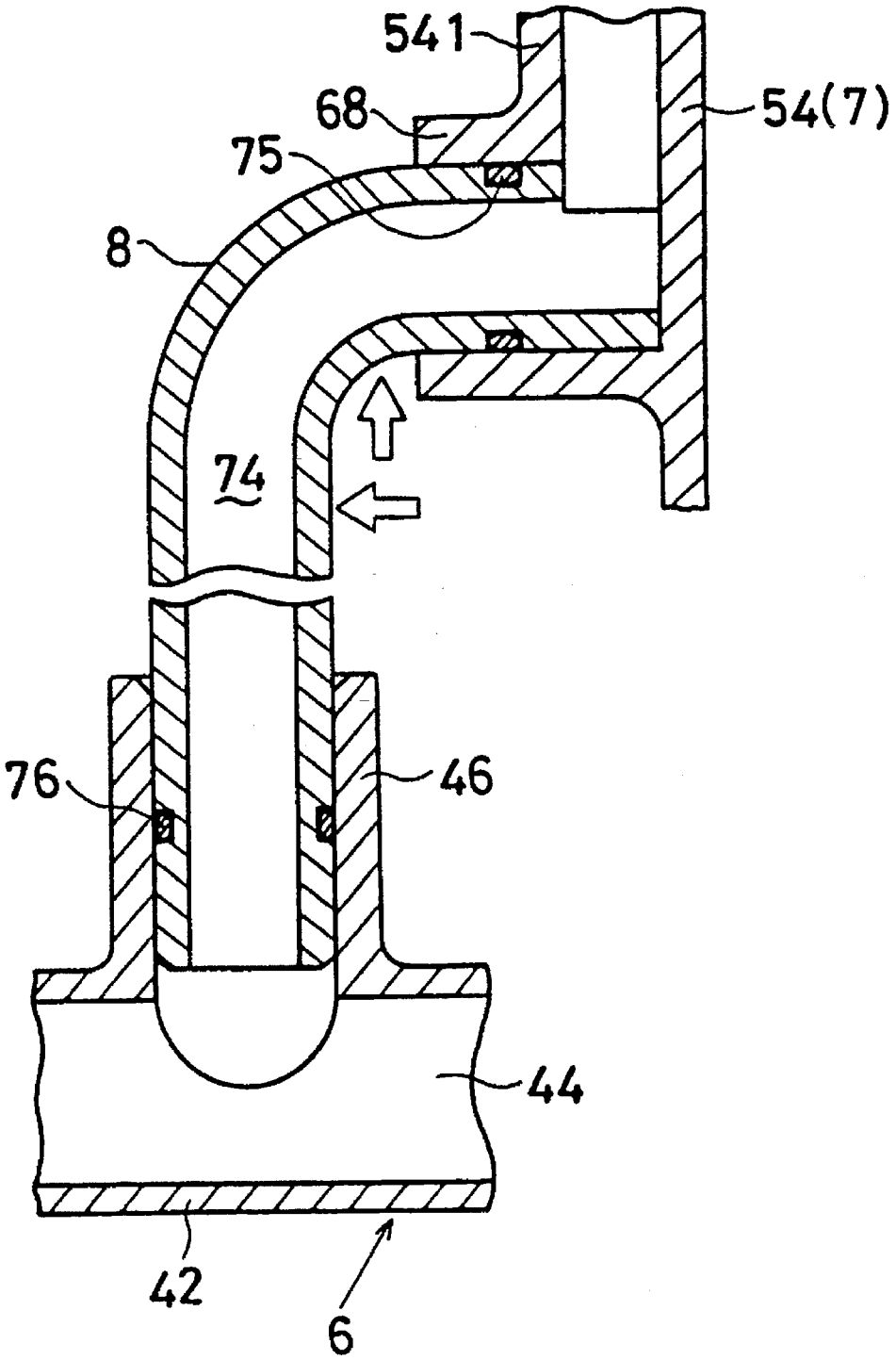
FIG. 5 is a cross-sectional view showing an essential structure of the reserve tank integrally provided with the heat insulating device shown in FIG. 4.
Figure 15:
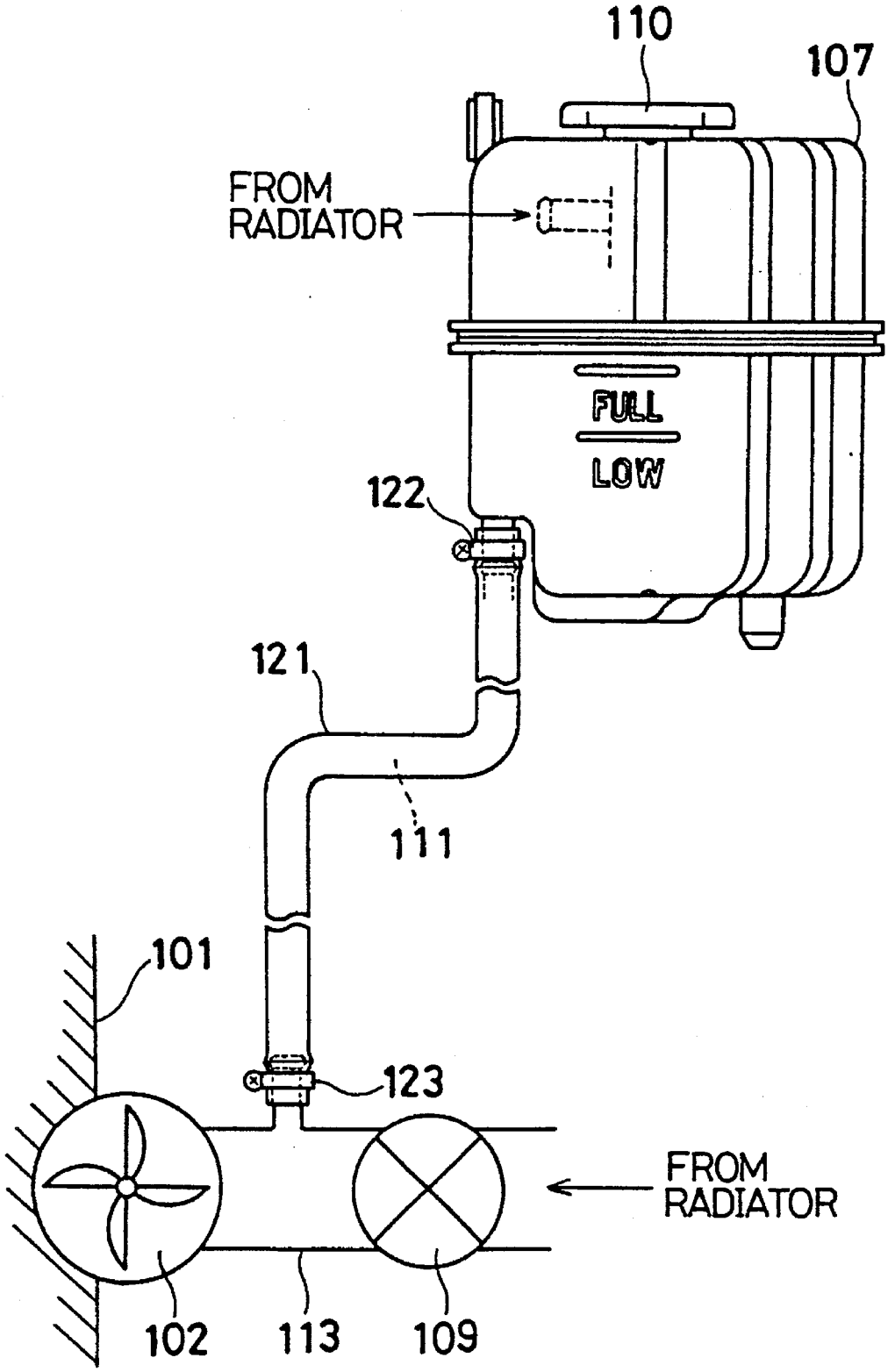
FIG. 15 PRIOR ART
FIG. 15 is an illustration showing an assembled structure of an engine and an conventional reserve tank.

The connection pipe 8 connects, as shown in FIG. 5, between the connection port 46 of the tank base 6 and the connection port 68 of the reserve tank body 7. Sealing members 75 and 76 such as O-rings are provided in respective annular grooves corresponding to the size of the sealing members 75, 76 on both ends of the connection pipe 8 for sealing the coolant. Both ends of the connection pipe 8 are inserted into the connection ports 46 and 68, respectively, which are managed in size for tightly sealing of the coolant. The connection pipe 8 is connectable to the coolant circuit 5, or coolant circulation route without binding members 122 and 123 such as hose bands as shown in FIG. 15, thus making it possible to reduce the number of parts, the number of assembly processes, and production costs. In this embodiment, even if a load is exerted in arrows directions in FIG. 5, the connection pipe 8 will never drop out by taking a proper margin for insertion in the connection ports 46 and 68.

The connection pipe 8 is assembled in a manner as follows. After the upper end portion of the connection pipe 8 on which the sealing member 75 such as an O-ring is provided is inserted into the connection port 68 of the reserve tank body 7, the heat insulating device 9 is fitted in the reserve tank body 7. The tank base 6 is then assembled at the lower portion of the heat insulating device 9 while the other end of the connection pipe 8 on which the sealing member 76 such as an O-ring is provided is inserted into the connection port 46 of the outlet pipe 42. Finally, the tank base 6, the reserve tank body 7, and the heat insulating device 9 are secured using angles 72 and 89 with binding members 73 and 90 such as bolts and nuts.

Figure 6:
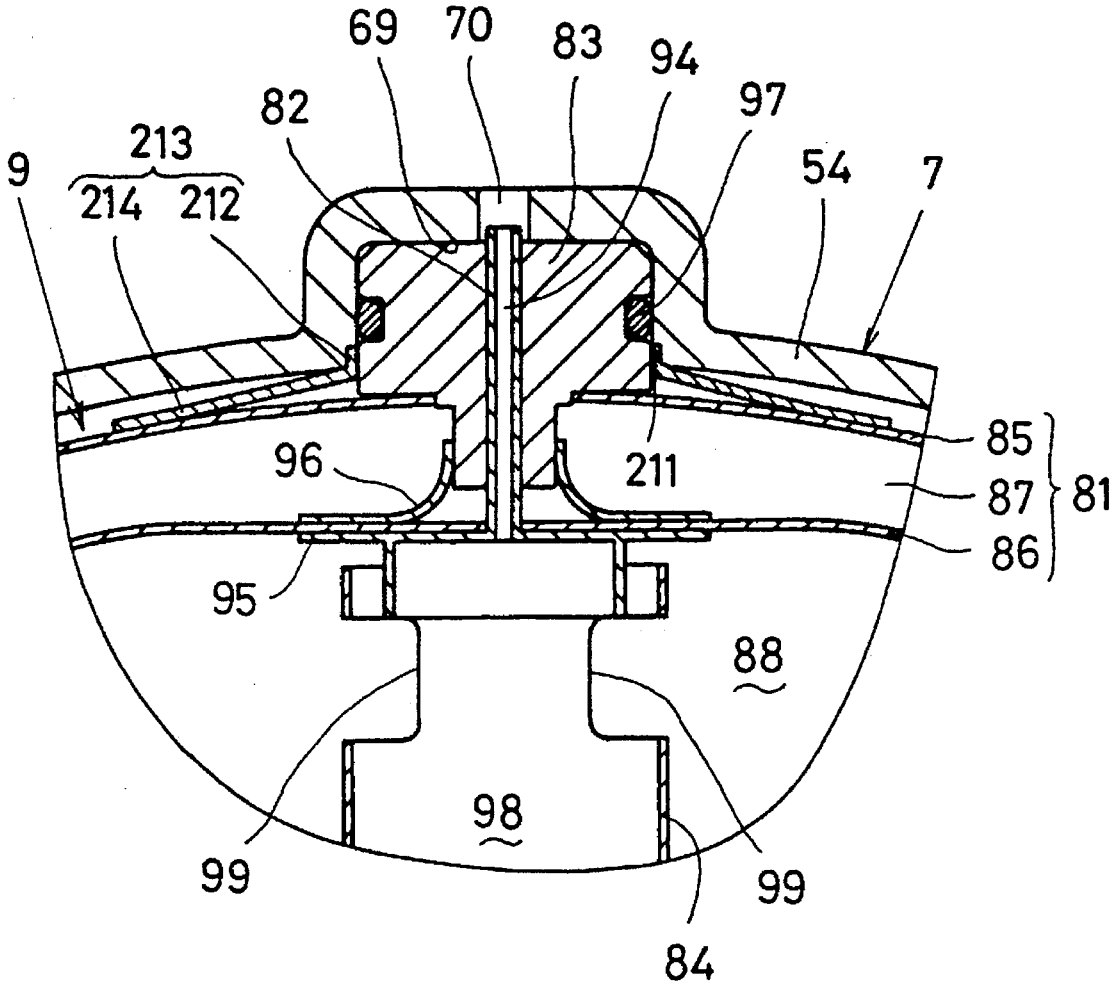
FIG. 6 is a cross-sectional view showing the whole structure of a reserve tank integrally provided with a heat insulating device according to a third embodiment of the present invention.
Figure 7:
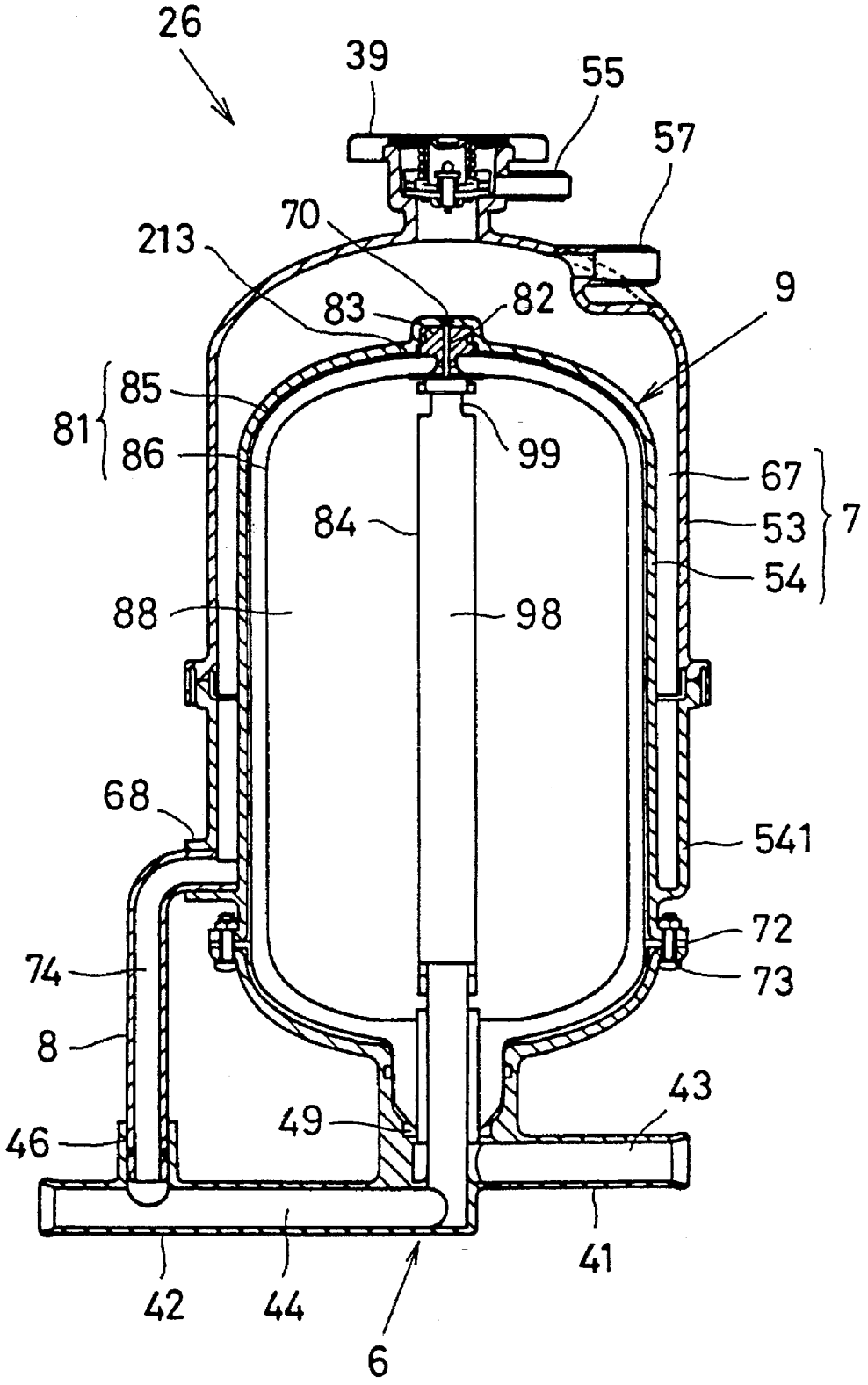
FIG. 7 is a cross-sectional view showing an essential structure of the reserve tank with the integrated heat insulating device shown in FIG. 6.
Figure 8A:
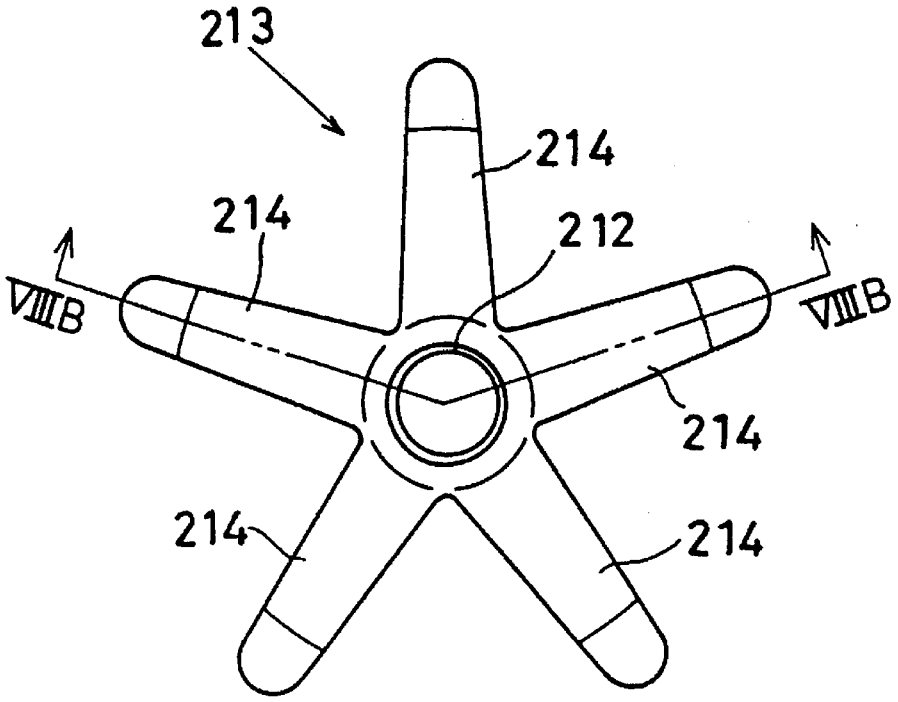
FIG. 8A is a plan view showing a leaf spring for the third embodiment.
Figure 8B:
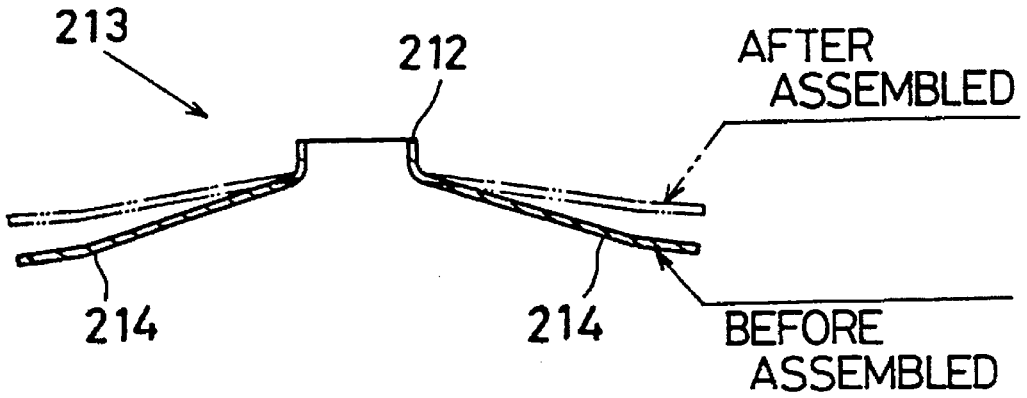
FIG. 8B is a cross-sectional view taken along the line VIIIB—VIIIB of FIG. 8A.

Another reserve tank with an integrated heat insulating device of the third embodiment according to the invention is described with reference to FIGS. 6 to 8. The heat insulating device 9 of the third embodiment includes a vacuum layer (heat insulating layer) 87 between the outer member 85 and the inner member 86 of the heat insulating device 9. The outer and inner members 85 and 86 are secured to each other with an inserted holder 83, a plate, 96, and a degassing connection pipe 82. A sealing member 97 such as an O-ring is provided to the outer periphery of the inserted holder 83. The inserted holder 83 is fitted to a recess 69 integrally formed with the top portion of the lower tank 54 of the reserve tank body 7 to seal the coolant, thereby preventing the coolant from leaking therefrom.

A leaf spring (pressing member, elastic member) 213 having a flange portion 212 is provided at recess portions 211 formed at the periphery of the recess 69 of the lower tank 54. The flange portion 212 of the leaf spring 213 is secured by being inserted in the recess portions 211 of the lower tank 54. The shape of the leaf spring 213 is not limited to the shape shown in FIGS. 8A and 8B and the leaf spring 213 can have a larger number of supports or legs 214 protruding from the flange 212 as the heat insulating device has a larger capacity. The solid line in FIG. 8B indicates the shape of the leaf spring before assembled; the broken line in FIG. 8B indicates the shape of the leaf spring after assembled.

When the heat insulating body 81 is fitted into the reserve tank body 7, the top portion of the outer member 85 of the heat insulating body 81 contacts with the supports 214 of the leaf spring 213. Then, as the heat insulating body 81 is further fitted into the reserve tank body 7, the top surface of the inserted holder 83 reaches the ceiling portion of the recess 69 of the reserve tank body 7, thereby ending this assembly process. The leaf spring 213 is compressed by a predetermined load to give resilient force. In this way, the heat insulating body 81 is surely fixed to the reserve tank body 7, even if clearances between the heat insulating body 81 and the reserve tank body 7 are fluctuated.

In this embodiment, angles 89 and mechanical binding members 90 such as bolts and nuts, which are required in the first embodiment, are not required, because the heat insulating body 81 is assembled between the tank base and the reserve tank body 7 by supporting an upper portion of the heat insulating body with respect to center of gravity with the leaf spring 213, where the tank base (supporting member) 6 and the reserve tank body 7 are assembled by using binding members 73 such as bolts and nuts with angles 72. Accordingly, only binding members 73 such as bolts and nuts (four pieces each) are required as the mechanical assembly for the reserve tank 26 integrally provided with the heat insulating device 9, and therefore, the tank 26 can reduce the number of mechanical parts to be assembled, as well as the number of assembling processes and the production costs.

Figure 9:
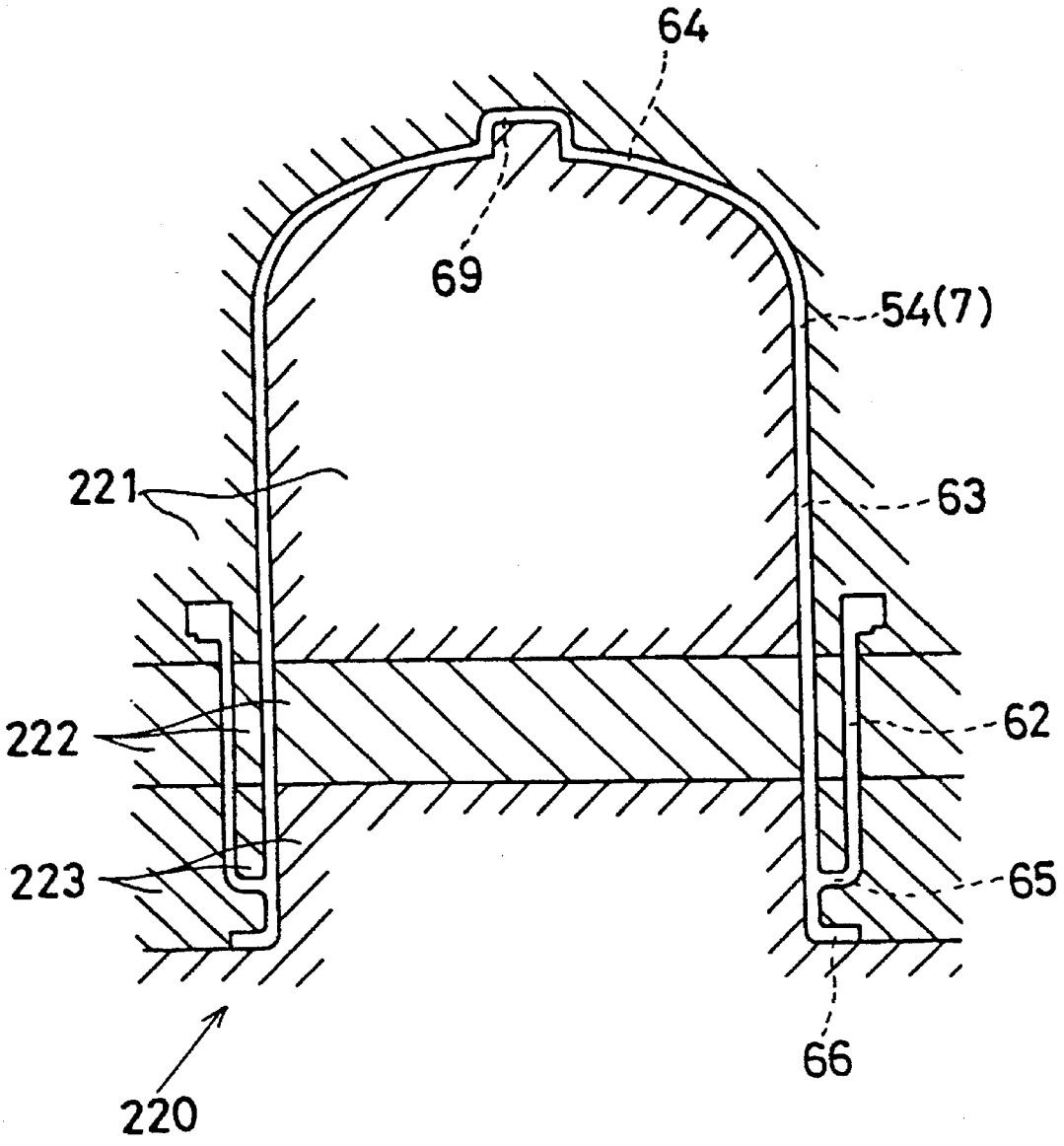
FIG. 9 is a cross-sectional view showing a die unit for forming the heat insulating bodies according to a fourth embodiment of the present invention.

A fourth embodiment is described with reference to FIGS. 9 to 11. The volume of the completely closed reserve tank body 7 for vehicles coolant is determined by factors such as an amount of volume expanded from the whole coolant volume under a higher temperature, air amount for applying the system pressure, and the like. Such reserve tanks, even have the same volume, require various type of shapes corresponding to restrictions when such tanks are installed in the vehicles. Therefore, various types of die units for those shapes are required at the production, thereby increasing the production costs of the reserve tanks.

In this embodiment, however, a pair of separable common dies 221, a pair of separable individual dies 222, and a pair of separable common dies 223 are prepared as a die unit for forming the reserve tank body 7, in particular, a die unit 220 for forming the lower tank 54. A die unit (not shown) for forming the upper tank 53 of the reserve tank body 7 can be commonly used regardless differences of coolant volumes. On the other hand, the die unit 220 for forming the lower tank 54 can be commonly used for almost the entire portion of the heat insulating device 9. In other words, the variation of the coolant volume is adjusted by arranging the vertical size of the separable individual die 222. That is, the die unit 220 for forming the lower tank 54 consists of the pair of the separable common dies 221, the pair of the separable individual dies 222, and the pair of the separable common dies 223 in this order from the top, a common use of the dies for almost the entire parts is realized as described above. Moreover, it is not so difficult to produce the separable individual die 222, because such a die determined by the coolant volume is used simply for obtaining a cylindrical shape.

Figure 10A:
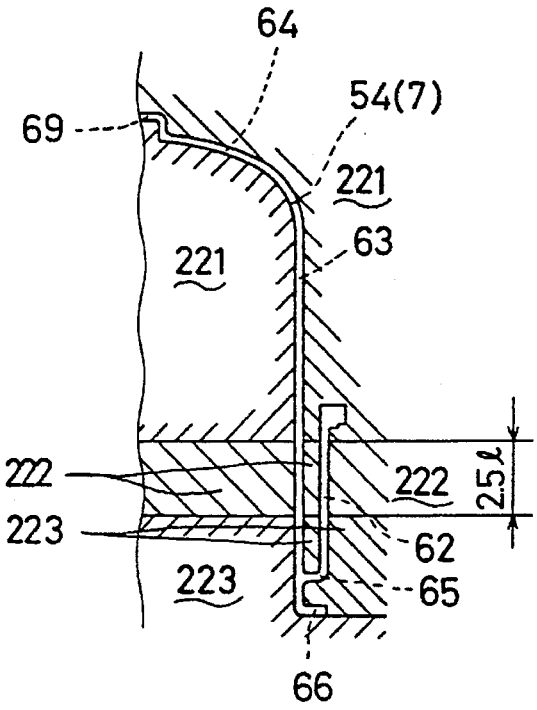
FIGS. 10A and 10B are cross-sectional-views showing reserve tanks integrally provided with the heat insulating devices.
Figure 10B:
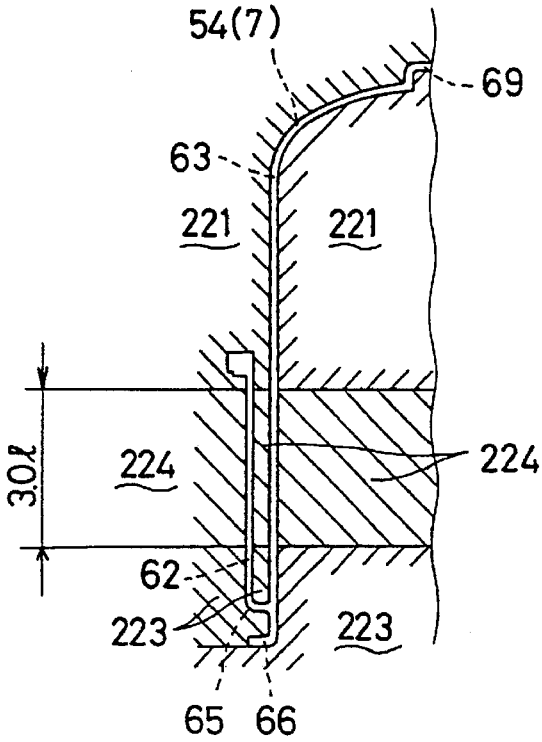
Figure 11B:
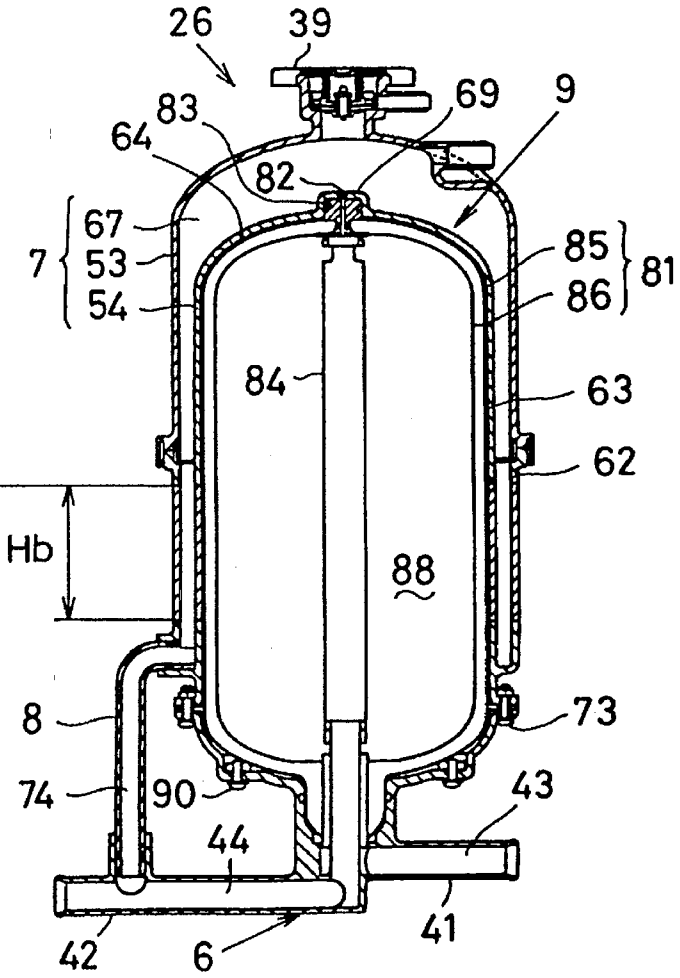
FIGS. 11A and 11B are cross-sectional views showing dies for the insulator bodies of FIGS. 10A and 10B, respectively.
Figure 11A:
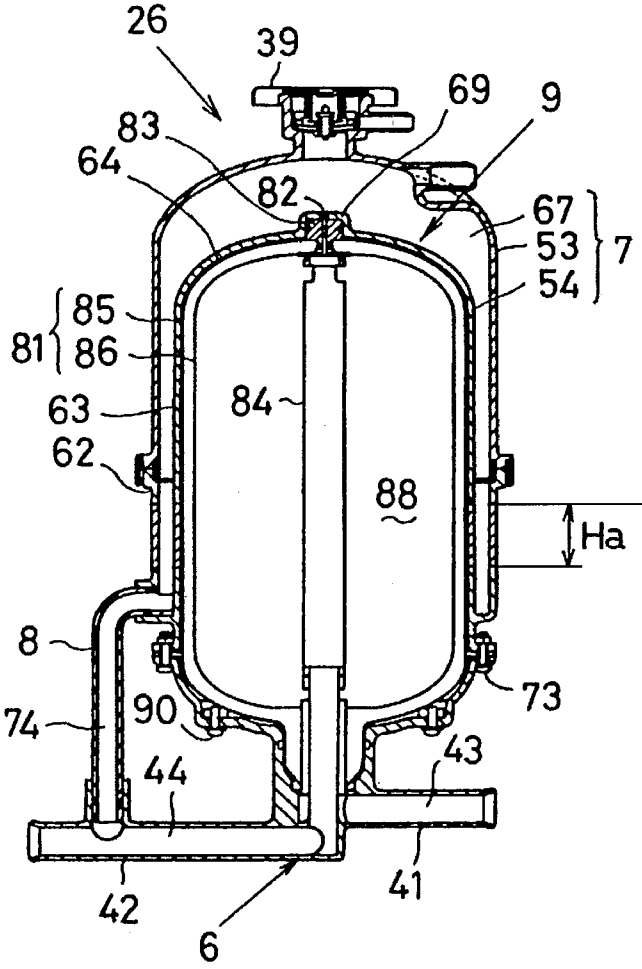

For example, when the heat insulating device 9 of coolant volume 2.5 liters as shown in FIG. 10A and the heat insulating device 9 of coolant volume 3.0 liters as shown in FIG. 10B are required, the reserve tank bodies 7 covering two coolant volume types of the heat insulating devices 9 are integrally formed by changing the dies between the pair of separable individual dies 222 having a short vertical size and the pair of the separable individual dies 224 having a long vertical size as shown in FIGS. 11A and 11B. That is, the reserve tank 26 integrally provided with the heat insulating device in which the heat insulating body 81 for accumulating a high temperature coolant and the reserve tank body 7 so placed as to cover the heat insulating body 81 are integrally connected, can be formed simply by changing portions of the die unit (such as individual dies 222 and 224), even if the entire coolant volume of the reserve tank body 7

(in particular, the coolant volume of the heat insulating body 81), which is determined by sum total of the coolant volume for vehicles coolant and the coolant volume in the heat insulating body 9, varies according to types or specifications of automobiles, so that the costs for molding the reserve tank bodies 7 with a resin material can be reduced.

Figure 12:
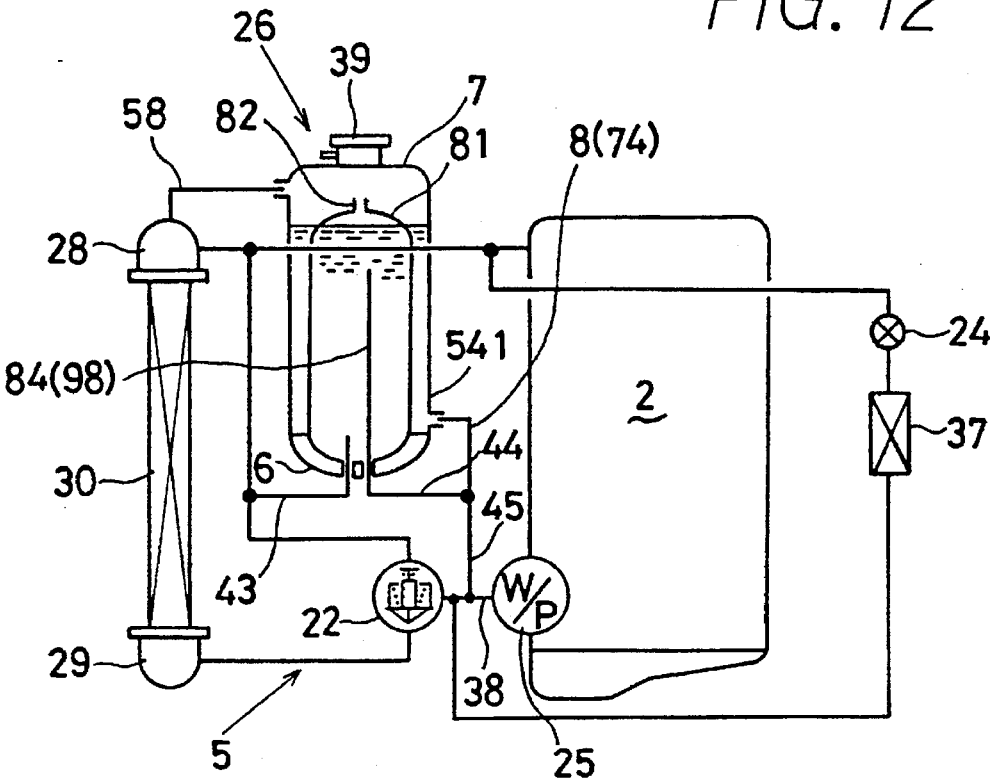
FIG. 12 is a coolant system diagram showing the whole structure of a warming-up apparatus for an automobile according to the fifth embodiment.
Figure 14:
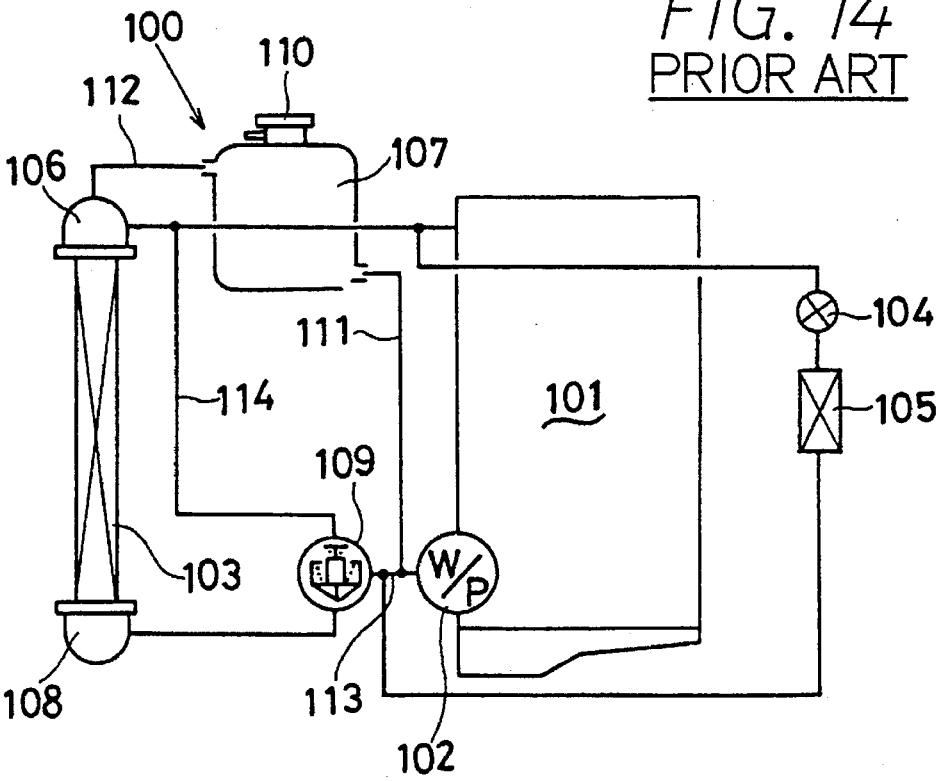
FIG. 14 PRIOR ART
FIG. 14 is a coolant system diagram showing the whole structure of a conventional warming-up apparatus for an automobile.
Figure 13:
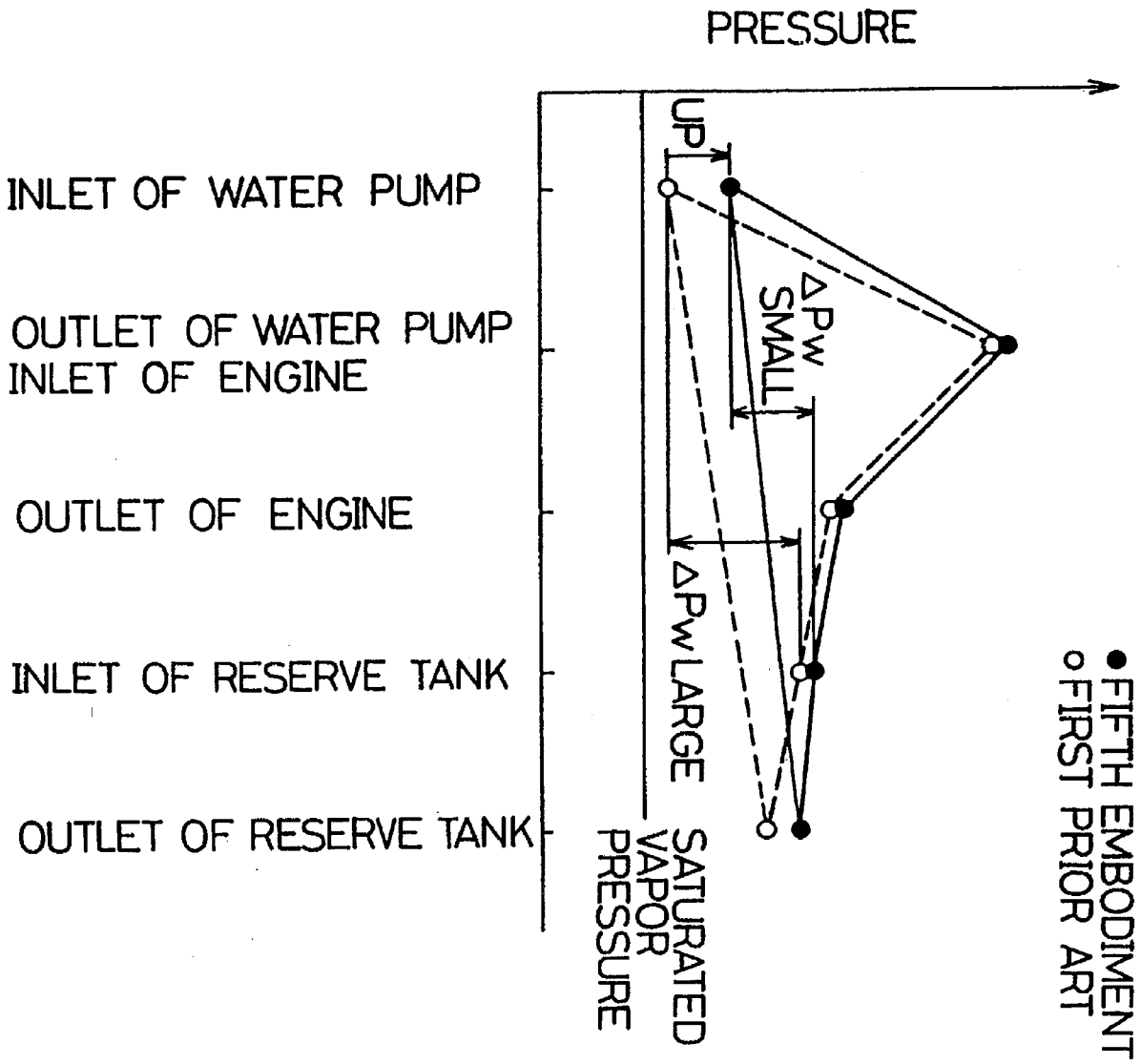
FIG. 13 is a graph showing pressure at respective measuring points in the coolant system of the fifth embodiment in comparison with the pressure in the conventional coolant system.

A fifth embodiment is described with reference to FIGS. 12 and 13. As shown in FIG. 14, in the coolant system for the vehicle on which the completely closed reserve tank body 107 is mounted, the coolant is communicated between the radiator 103 and the reserve tank body 107, between the internal combustion engine 101 and the reserve tank body 107, and between the inlet of the water pump 102 and the reserve tank body 107. The most important parts for such communications are the inlet of the water pump 102 and the pressure circuit 111 in communication with the reserve tank body 107 to serve for degassing, applying the system pressure, and pouring the coolant as functions of the reserve tank body 107. A long rubber hose, however, normally communicates between the outlet of the reserve tank body 107 and the inlet of the water pump 102, and therefore, such a rubber hose creates considerable resistance against fluid passage, so that the system pressure by the pressure cap 110 not be applied effectively, as shown in FIG. 13, due to a lowered pressure (large ΔPw). In general, a cavitation may occur at the inlet of the water pump 102, if the pressure of the coolant circuit becomes lower than the saturation vapor pressure of the coolant. Accordingly, there causes a problem, or inconvenience, that the coolant system, specially the water pump, cannot solve the cavitation problem effectively, where the coolant system is more restricted these days in vehicles.

A main flow of the coolant in the coolant circuit 5 in this embodiment is described as follows. The coolant having flowed from the upper tank 28 of the radiator 21 flows into the reserve tank body 7 through the degassing circuit 58. If air is entrained in the coolant at that time, the air is separated from the coolant in the reserve tank body 7. Subsequently, the coolant having flowed out of the lowest portion of the skirt portion 541 of the reserve tank body 7 flows into the suction pipe 38 formed between the thermostat 22 and the water pump 25 through the pressure circuit 45 while receiving a system pressure (for example, 0.9 kg/cm2) determined by the temperature and the like at that time and applied by the pressure cap 39, and is distributed to the respective parts of the engine 2 by the water pump 25.

The upper-most portion of the heat insulating body 81 communicates with the reserve tank body 7 through the degassing connection pipe 82 provided for degassing as described in the first embodiment. The pressure by the pressure cap 39 is also applied to the coolant in the reserve tank body 7, and therefore, the coolant similarly flows into the engine 2 from the suction pipe 38, thereby applying a uniform internal pressure to the respective parts of the engine 2.

As compared with the coolant circuit of the conventional engine cooling apparatus 100 shown in FIG. 14, according to the coolant circuit 5 in the embodiment, the pressure loss due to the pressure circuit 45 is made smaller as shown in FIG. 13 and the water pump 25 can have an increased sucking pressure, because the long skirt portion 541 of the reserve tank body 7 increases a cross section for fluid passage regarding the pressure circuit 45 in addition to applying the pressure from the flowing-out portion of the heat insulating body 81, as well as the length of fluid passage can be shortened. That is, when the engine speed is the same and the water temperature at the inlet of the water pump 25 is the same (the sane system pressure), a cavitation does not occur readily, because the margin to the saturation vapor temperature becomes large. Therefore, the fans of the water pump 25 or the like can be used for a longer period of time.

Although the inlet pipe 41 of the heat insulating device 9 is connected to the bypass passage 33 in the above embodiments, the inlet pipe 41 of the heat insulating device 9 may be connected to the upper tank 28 of the radiator 21 or a midway of the coolant circuit 5 at which the coolant temperature becomes relatively high.

Although in the fourth embodiment the separable individual dies 222 and 224 in which the outer and inner cylindrical walls 62 and 63 of the lower tank 54 have the same diameter are used, an individual die may be used in which the diameters of the outer and inner cylindrical walls 62 and 63 of the lower tank 54 can be changed in a midway.

The foregoing description of a preferred embodiment of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention not to be limited by the specification, but be defined by the claims set forth below.

What is claimed is:

1. An engine warming-up apparatus for a vehicle having a water-cooled engine mounted thereon, said engine warming-up apparatus comprising:

a reserve tank having a water filling opening though which coolant is poured in a cooling system of the water-cooled engine, said reserve tank degassing said coolant of the cooling system; and a heat insulating device having an upper portion and a lower portion, said heat insulating device being constantly supplied with circulating coolant at said lower portion for accumulating the heat of said coolant therein, said upper portion of said heat insulating device being covered with said reserve tank to form a reserve tank space therebetween, said heat insulating device including a degassing passage located in said upper portion of said heat insulating device for communicating with said reserve tank space and an outlet pipe (84) having an opening at said upper portion for directing the coolant out of said heat insulating device.

2. An engine warming-up apparatus according to claim 1, wherein said reserve tank includes:

a tank base formed in a cup-like shape and having an inner wall on which said heat insulating device is mounted;

a reserve tank body disposed above said tank base so as to surround said heat insulating device and having an inside space in which the coolant is stored; and a pressing member located between a top portion of said heat insulating device and a lower portion of said reserve tank body for pressing said heat insulating device onto said inner wall of said tank base.

3. An engine warming-up apparatus according to claim 2, wherein the pressing member is a resilient body capable of being elastically transformed.

4. An engine warming-up apparatus according to claim 2, further comprising:

a pressure cap equipped with a vacuum relief valve is provided at said water filling opening to control an internal pressure of said inside space.

5. An engine warming-up apparatus according to claim 2, wherein said reserve tank body is made of a resin material.

6. An engine warming-up apparatus according to claim 2, wherein a lower portion of said reserve tank body is integrally molded with a die unit including three pairs of dies, common dies, separable individual dies and separable common dies, in this order along an axis of said reserve tank body.

7. An engine warming-up apparatus according to claim 6, wherein an axial length of said lower portion of said reserve tank body is controlled by an axial length of said separable individual dies.

8. A heat insulating device for coolant of an internal combustion engine, said heat insulating device comprising:

a reserve tank;

a heat insulating body disposed within said reserve tank, said reserve tank and said heat insulating body forming a reserve tank space therebetween, said heat insulating body having an upper portion and a lower portion for accumulating heat of said coolant having flowed into said lower portion and out of said upper portion; and an outlet pipe having a coolant opening at said upper portion for directing said coolant out of said heat insulating body, wherein a degassing passage is formed in said upper portion of said heat insulating body for communicating between an inside and an outside of said heat insulating body.

9. An engine warming-up apparatus for a vehicle having a water-cooled engine mounted thereon, said engine warming-up apparatus comprising:

a reserve tank having a water filling opening though which coolant is poured in a cooling system of the water-cooled engine, said reserve tank degassing said coolant of the cooling system, said reserve tank including:

a tank base formed in a cup-like shape and having an inner wall on which a heat insulating device is mounted;

a reserve tank body disposed above said tank base so as to surround said heat insulating device and having an inside space in which the coolant is stored; and a pressing member located between a top portion of said heat insulating device and a lower portion of said reserve tank body for pressing said heat insulating device onto said inner wall of said tank base; and said heat insulating device supplied with circulating coolant constantly for accumulating the heat of said coolant therein, at least at an upper side of said heat insulating device being covered with said reserve tank, said heat insulating device including a degassing passage located around an upper-most portion of said heat insulating device for communicating with said reserve tank and an outlet pipe having an opening at said upper-most portion for flowing the coolant out of said heat insulating device.

10. An engine warming-up apparatus according to claim 9, wherein the pressing member is a resilient body capable of being elastically transformed.

11. An engine warming-up apparatus according to claim 9, further comprising:

a pressure cap equipped with a vacuum relief valve is provided at said water filling opening to control an internal pressure of said inside space.

12. An engine warming-up apparatus according to claim 9, wherein said reserve tank body is made of a resin material.

13. An engine warming-up apparatus according to claim 9, wherein a lower portion of said reserve tank body is integrally molded with a die unit including three pairs of dies, common dies, separable individual dies and separable common dies, in this order along an axis of said reserve tank body.

14. An engine warming-up apparatus according to claim 13, wherein an axial length of said lower portion of said reserve rank body is controlled by an axial length of said separable individual dies.

* * * * *

UNITED STATES PATENT AND TRADEMARK OFFICE

CERTIFICATE OF CORRECTION

PATENT NO. : 5,662,072

DATED : September 2, 1997

INVENTOR(S) : Kazutaka Suzuki et al

It is certified that error appears in the above-identified patent and that said Letters Patent is hereby corrected as shown below:

Title Page, [57] Abstract, line 9, "located-between" should be --located between--

Col. 1, lines 59-60. "warming up" should be --warming-up--

Col. 1, lines 60-61, "raise problems" should be --problems are raised--

Col. 1, line 61, "warming up" should be --warming-up--

Col. 2, line 29, "accumulates" should be --accumulate--

Col. 3, line 15, "possible]" should be --possible--

Col. 4, line 8, "cross-sectional-views" should be --cross-sectional views--

Col. 4, line 27, "an" should be --a--

Col. 4, line 60, "directing" should be --directed to--

Col. 5, line 10, delete "so"

Col. 5, line 11, after "temperature" insert --so--

Col. 5, line 38, "directing" should be --directed to--

Col. 5, line 59, "next," should be --Next,--

Col. 6, line 55, delete "of"

Col. 6, line 67, "t9" should be --to--

UNITED STATES PATENT AND TRADEMARK OFFICE

CERTIFICATE OF CORRECTION

PATENT NO. : 5,662,072

DATED : September 2, 1997

INVENTOR(S) : Kazutaka Suzuki et al

It is certified that error appears in the above-identified patent and that said Letters Patent is hereby corrected as shown below:

Col. 7, line 9, "Upper" should be --upper--

Col. 7, line 12, delete "an"

Col. 7, line 13, "inserted" should be --inserted,--

Col. 7, line 26, "materials" should be --material--

Col. 7, line 53, "an" should be --a--

Col. 8, line 36, "materials" should be --material--

Col. 8, line 61, 1st occurrence of "is" should be --in--

Col. 9, line 17, "Volume" should be --volume--

Col. 9, line 31, "upper tank 2" should be --upper tank 28--

Col. 9, line 31, "radiator 28" should be --radiator 21--

Col. 10, line 23, "device 9, it" should be --device 9. It--

Col. 11, line 39, "plate, 96," should be --plate 96,--

Col. 12, line 11, delete "vehicles" and substitute --the vehicle's-- therefor

Col. 12, line 26, "have" should be --having--

UNITED STATES PATENT AND TRADEMARK OFFICE

CERTIFICATE OF CORRECTION

PATENT NO. : 5,662,072

DATED : September 2, 1997

INVENTOR(S) : Kazutaka Suzuki et al

It is certified that error appears in the above-identified patent and that said Letters Patent is hereby corrected as shown below:

Col. 12, line 37, after "regardless" insert --of--

Col. 12, line 46, "top, a" should be --top. A--

Col. 13, line 3, delete "vehicles" and substitute --the vehicle's-- therefor

Col. 14, line 1, "sane" should be --same--

Col. 16, line 37, claim 14, "rank" should be --tank--

Signed and Sealed this

Nineteenth Day of January, 1999

*Attest:*

*Attesting Officer*

*Acting Commissioner of Patents and Trademarks*